US009446285B1

(12) United States Patent
Drath et al.

(10) Patent No.: US 9,446,285 B1
(45) Date of Patent: Sep. 20, 2016

(54) UNSUPPORTED PELVIC/SPINE EXERCISE SYSTEM AND METHOD

(71) Applicants: Thomas Walter Drath, Phoenix, AZ (US); Daniel Albert Drath, Phoenix, AZ (US)

(72) Inventors: Thomas Walter Drath, Phoenix, AZ (US); Daniel Albert Drath, Phoenix, AZ (US)

( * ) Notice: Subject to any disclaimer, the term of this patent is extended or adjusted under 35 U.S.C. 154(b) by 94 days.

(21) Appl. No.: 14/192,150

(22) Filed: Feb. 27, 2014

Related U.S. Application Data

(60) Provisional application No. 61/771,729, filed on Mar. 1, 2013.

(51) Int. Cl.
*A63B 23/02* (2006.01)

(52) U.S. Cl.
CPC ..... *A63B 23/0211* (2013.01); *A63B 23/0233* (2013.01)

(58) Field of Classification Search
CPC ... A63B 21/00047; A63B 21/00083–21/0009; A63B 21/062–2021/0623; A63B 21/1457–21/1461; A63B 23/0211; A63B 23/0233; A63B 21/0442; A63B 21/0632; A63B 23/0222
See application file for complete search history.

(56) References Cited

U.S. PATENT DOCUMENTS

| | | | | |
|---|---|---|---|---|
| 6,152,866 | A * | 11/2000 | Kuo | A63B 21/055 482/130 |
| 6,248,047 | B1 * | 6/2001 | Abdo | A63B 21/023 482/121 |
| 6,387,024 | B1 * | 5/2002 | Monti et al. | 482/142 |
| 7,322,911 | B2 * | 1/2008 | Webber | A63B 23/02 482/142 |
| 8,096,926 | B1 * | 1/2012 | Batca | 482/99 |
| 2007/0129225 | A1 * | 6/2007 | Hammer | A63B 21/0552 482/129 |
| 2008/0200319 | A1 * | 8/2008 | Fong | 482/144 |
| 2009/0264265 | A1 * | 10/2009 | Contreras | 482/99 |
| 2013/0337984 | A1 * | 12/2013 | Lung | A63B 21/0421 482/140 |
| 2013/0345031 | A1 * | 12/2013 | Chiu | A63B 21/0421 482/130 |
| 2014/0087928 | A1 * | 3/2014 | Luedeka | 482/130 |

OTHER PUBLICATIONS

Weight Watchers, "Roman Chair Side Bends—Women"; http://www.weightwatchers.com/util/art/index_art.aspx?tabnum=1&art_id=46921&sc=3042, Screen shot taken Feb. 23, 2014.

Author Unknown, "Roman Chair Side Bends"; http://www.ucgenvucut.com/hareketler/karin-kasi-gelistirme-hareketleri/roman-chair-side-bends.html; Screen shot taken Feb. 23, 2014.

Jorge Cruise, "Oblique Exercise"; http://www.lifescript.com/diet-fitness/tips/b/bend_it_like_jorge.aspx; Screen shot taken Feb. 23, 2014.

Author Unknown, "Side Bends on the 45 Degree Slant Board Hands Behind the Head Variation"; http://www.ab-core-and-stomach-exercises.com/abdominal-exercise-equipment.html; Screen shot taken Feb. 23, 2014.

(Continued)

*Primary Examiner* — Oren Ginsberg
*Assistant Examiner* — Jennifer M Deichl
(74) *Attorney, Agent, or Firm* — Venjuris, P.C.

(57) ABSTRACT

The invention is embodied in an exercise system that can allow its user to counterbalance the effects associated with a predominantly sedentary lifestyle though a fitness device that comprises a combination of (a) supporting the lower body in a manner that permits a user's upper body to act as a third class lever with the user's hips operating as fulcrum and (b) engaging in resistance exercises with the upper body in a horizontal position, unsupported above the greater trochanter.

20 Claims, 16 Drawing Sheets

(56) References Cited

OTHER PUBLICATIONS

Shawn Shelstad, "Side Bends at Hyperextension"; http://www.youtube.com/watch?v=T3QxG0ZOOKk; Screen shot taken Feb. 23, 2014.
HEYNOW951; "Hyper Extension Machine—Yukon Fitness (HYP-156)"; http://www.youtube.com/watch?v=zUJNYXjku6o; Screen shot taken Feb. 23, 2014.
Tom Lambert; "Core exercises for skiing (and life!)"; http://ultraskier.com/ski-fitness/core; Screen shot taken Feb. 23, 2014.
Uknown Author; "Roman Chair—Powerline by Body-Solid (PCH24X)"; http://www.ironcompany.com/romanchairpowerlinebybody-solidpch24x.aspx#.Uwtv9YVstEQ; Screen shot taken Feb. 23, 2014.
Joe Wuebben, "Roman Chair Twist Train your abs hard. Here's one exercise that does it all."; http://www.muscleandfitness.com/workouts/abs-exercises/roman-chair-twist; Screen shot taken Feb. 23, 2014.
Author Unknown, http://natal-fitness.com/wp-content/uploads/2012/07/a1.jpg;Screen shot taken Jan. 8, 2013.
Lucy Oliver; "5, tough, abs, exercises, flat, fast, abdominal, workout, greenster.com, pike side bend roman chair"; http://www.greenster.com/magazine/5-tough-abdominal-exercises-flat-abs-fast/5-tough-abs-exercises-flat-fast-abdominal-workout-greenster-com-pike-side-bend-roman-chair/; Screen shot taken Feb. 23, 2014.
Greg Glassman The Glute-Ham Developer Sit-Up, The CrossFit Journal, Oct. 2005, Issue #38.
Author Unknown; "Most Popular Great Value"; http://www.backtrainer.com/; Screen shot taken Feb. 23, 2014.

* cited by examiner

UNSUPPORTED PELVIC/SPINE EXERCISE SYSTEM AND METHOD

CROSS-REFERENCE TO RELATED APPLICATIONS

The present application claims priority to United States provisional patent application entitled "Unsupported Pelvic/Spine, Third Class Lever Exercise System and Method" and filed under the title "BioGist—MyoReactive Trainer" having Ser. No. 61/771,729, filed on Mar. 1, 2013, which is entirely incorporated herein by reference.

FIELD OF THE INVENTION

The present invention relates to devices and methods for exercising the human body.

BACKGROUND

It is well known that the human body is incredibly adaptive and will continuously adapt and adjust to its environment. This adaptive ability is sometimes referred to as a correlative adaptive physiological response.

Our cultural transition to becoming a primarily sedentary population has been developing respectively as we have moved toward a more informational based economy. As a result, people find themselves spending an ever-increasing amount of time in various types of seated/sedentary environments. While transcending the more physically arduous labor intensive lifestyles of previous agricultural industrial generations, this cultural transition has yielded some undesired human physiological adaptations.

Research directed towards studying the adverse physiological effects of this sedentary shift clearly indicates that a chronically sedentary lifestyle increases the risk of conditions like obesity, cardiovascular disease, and hypertension.

What is perhaps less obvious is that a primarily sedentary lifestyle also affects our ability to adequately support our center bodies. At least in part, this systemic deactivation of our center body support system (i.e., our "core" muscles) is evidenced by the more than 100 billion dollars spent annually in this country to treat spine related disorders.

More specifically, prolonged artificial stabilization of the pelvis and/or spine, by sitting in a chair for example, deactivates the "inner unit", i.e., the very muscles designed to support the body's spine. For purposes of this specification, the term "inner unit" refers to the set of muscles that provides center body foundational support (i.e., the pelvic floor, diaphragm, transverse abdominus, internal oblique, multifidus). Likewise, the term "outer unit" refers to the muscles that move the center body (i.e., rectus abdominus, external oblique, latissimus dorsi). Together, the inner unit and the outer unit comprise what is known in the art as the body's "core."

While methods for strengthening the "outer unit" are well known in the art and effective, methods for strengthening the "inner unit" tend to be difficult for the user to perform correctly. As a result, users of the presently known methods for training the inner unit typically fail to activate, optimally strengthen, or "re-educate" the user's inner unit.

Among other things, none of today's currently accepted methods for re-educating or optimizing core function via the deep spinal stabilizers have proven equal to the task of meeting the needs of an ever increasingly sedentary population. More specifically, current bridging and bracing techniques, standing functional trainers, and traditionally designed exercise equipment simply fail to meet the mandated activation criteria compulsory for re-educating the deep spinal stabilizers of the inner unit. The inherent vertical user orientation of standing functional trainers (while having some functional merit) promote compressive spinal loading, which also does not mandate optimal activation and should be avoided until users have acquired the necessary "inner unit" strength to resist compressive loads.

Lastly, traditionally designed exercise equipment fails entirely because such equipment artificially stabilizes a user's pelvis and/or spine during various types of upper extremity force production. Artificial stabilization of the pelvis/spine is completely antithetical to optimizing core function, as being chronically sedentary is the primary culprit for the weakening of our center bodies. These prior art strategies have proven only to perpetuate an already per-existing imbalance between our body's core and our extremities.

What is needed is an exercise system that is capable of inherently optimizing core function and thereby effectively counterbalancing the undesired physiological effects of living in a primarily sedentary culture.

SUMMARY OF THE INVENTION

The physical problems associated with a predominantly sedentary lifestyle are solved by the combination of (a) supporting the lower body in a manner that permits a user's hips to operate as a fulcrum, unsupported above the greater trochanter; and (b) engaging in open kinetic chain resistance exercises with the upper body in a horizontal position (i.e. operating as a "third class lever"). For the purposes of this specification, the word "torso" means main part of the human body not including the head, arms, and legs. In other words, a reader should understand the use of the word "torso" to mean the region of a human body housing the spine and pelvis, which is sometimes also referred to as body's "trunk."

By supporting the legs below the greater trochanter so that the upper body can perform open kinetic chain resistance exercises in horizontal unsupported-torso positions, the invention effectively mandates that the upper body act as a third class lever with the hips as the fulcrum, both when the upper body is held static and when the upper body engages in movement. In this way, the invention provides maximum functional transfer to strengthening the inner unit, while exploiting the mechanical disadvantage created at the user's hip fulcrum when the upper body attempts to resist an external force (including gravity alone). In this way, the invention effectively mandates optimal center body activation, particularly when the upper extremities generate force in an open kinetic chain environment. It is believed that this is the optimum exercise environment when training the center body and strengthening the inner unit.

The presently preferred embodiment of the invention is a combination of (a) supporting the lower body in a manner that permits a user upper body to act as a third class lever in at least three positions: an up-facing position, a down-facing position, and a side-facing position. Then, once the body is in one of the three positions, engaging in open kinetic chain resistance exercises with the upper body (i.e., the torso) unsupported. Alternate embodiments include stand-alone versions of the device to support a user in one of the following positions: (1) a face-down position, (2) a side-facing position, or (3) a face-up position.

One object of this invention is to allow users to engage in progressive resistance exercises in a relatively non-compressive spinal loaded third class lever environment, wherein a mandated optimal ratio of co-contraction in the body's core will ensure ideal foundational support during extremity force production.

Another object of this invention is to introduce exercise equipment (aside from a standing functional trainer), that do not artificially support either the pelvis or the spine (together the "torso") during upper extremity force production. In this way, the invention provides the mechanical design to counterbalance the unwanted impacts of living in a primarily sedentary culture.

Another object of this invention is to teach the use of an apparatus that only supports a user's tibia and femur. In this way, the invention allows a user's upper body to act as a third class lever with the user's hips as the fulcrum while the user engages in a variety of upper body resistance exercises.

Another object of this invention is to create a method that more accurately reflects the functional anatomical demands of real life; it will provide the users with more effective maximum potential transfer into improving daily activities.

Another object of this invention is to introduce a healthier and more effective selection of machine-based training equipment.

Another object of this invention is that people can achieve safer and more effective muscle strengthening in a shorter period of time.

Another object of this invention is to provide the necessary intellectual and application framework necessary to re-write the currently accepted scientific protocols for spinal segmental stabilization. This will in turn provide physical therapists with improved techniques to more effectively ameliorate today's spinal stabilization demands.

Another object of this invention is to provide the athletic performance communities with the much awaited next logical progression in core stabilization. This method can then be more effectively assimilated into current functional training paradigms in the most effective manner possible. That is because the application of this system doesn't require a separate time allocated approach to facilitate. Rather, it can be facilitated while engaging in otherwise conventionally administered strength and conditioning protocols.

Another object of this invention is to introduce a technologically advanced alternating plane elbow enhanced arm assembly that will also revolutionize the "functional trainer" genre of exercise equipment. The advanced design technology will provide users with increased versatility during various types of standing force generated movement patterns.

The structure, overall operation and technical characteristics of the present invention will become apparent with the detailed description of a preferred embodiment and the illustration of the related drawings as follows.

BRIEF DESCRIPTION OF THE DRAWINGS OR PICTURES

Figure 2:
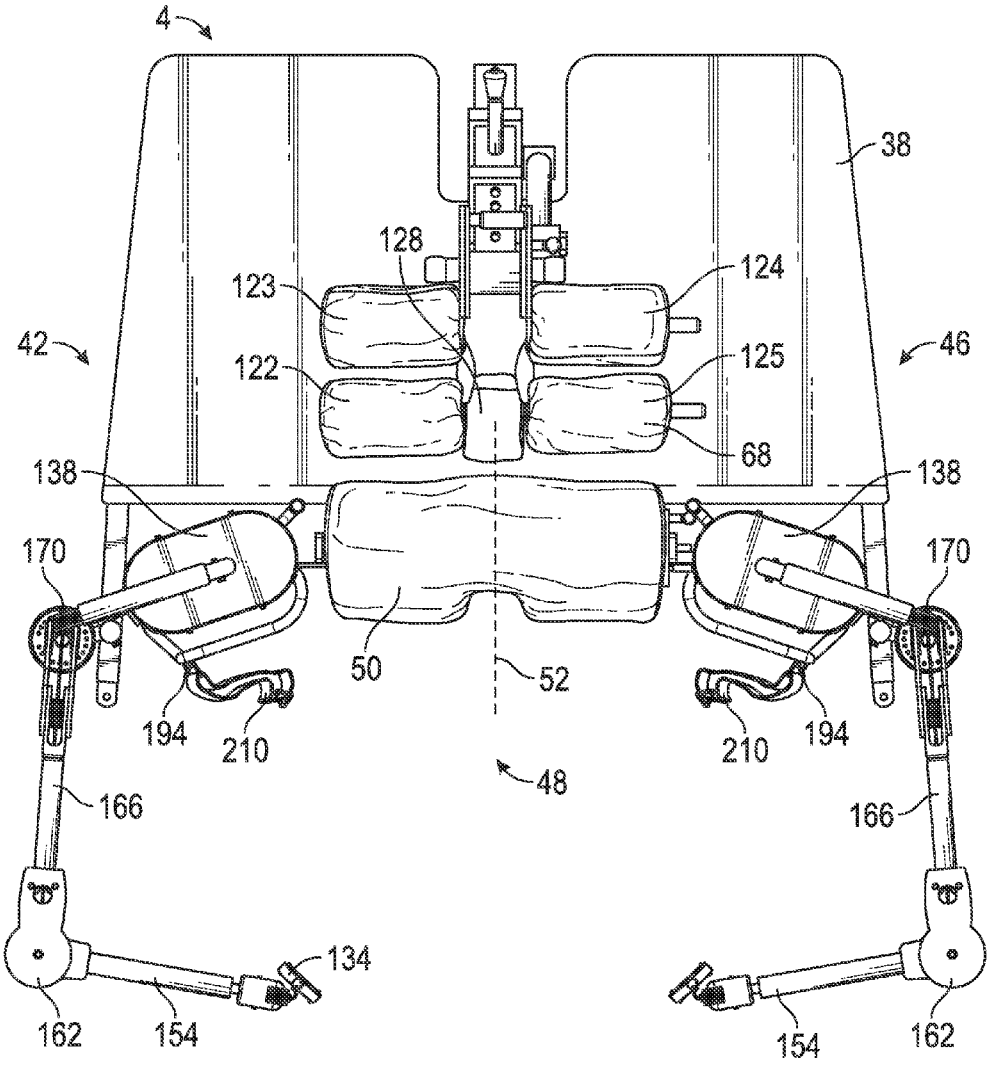
FIG. 2 illustrates a top view of the preferred embodiment of the fitness device of FIG. 1.
Figure 3:
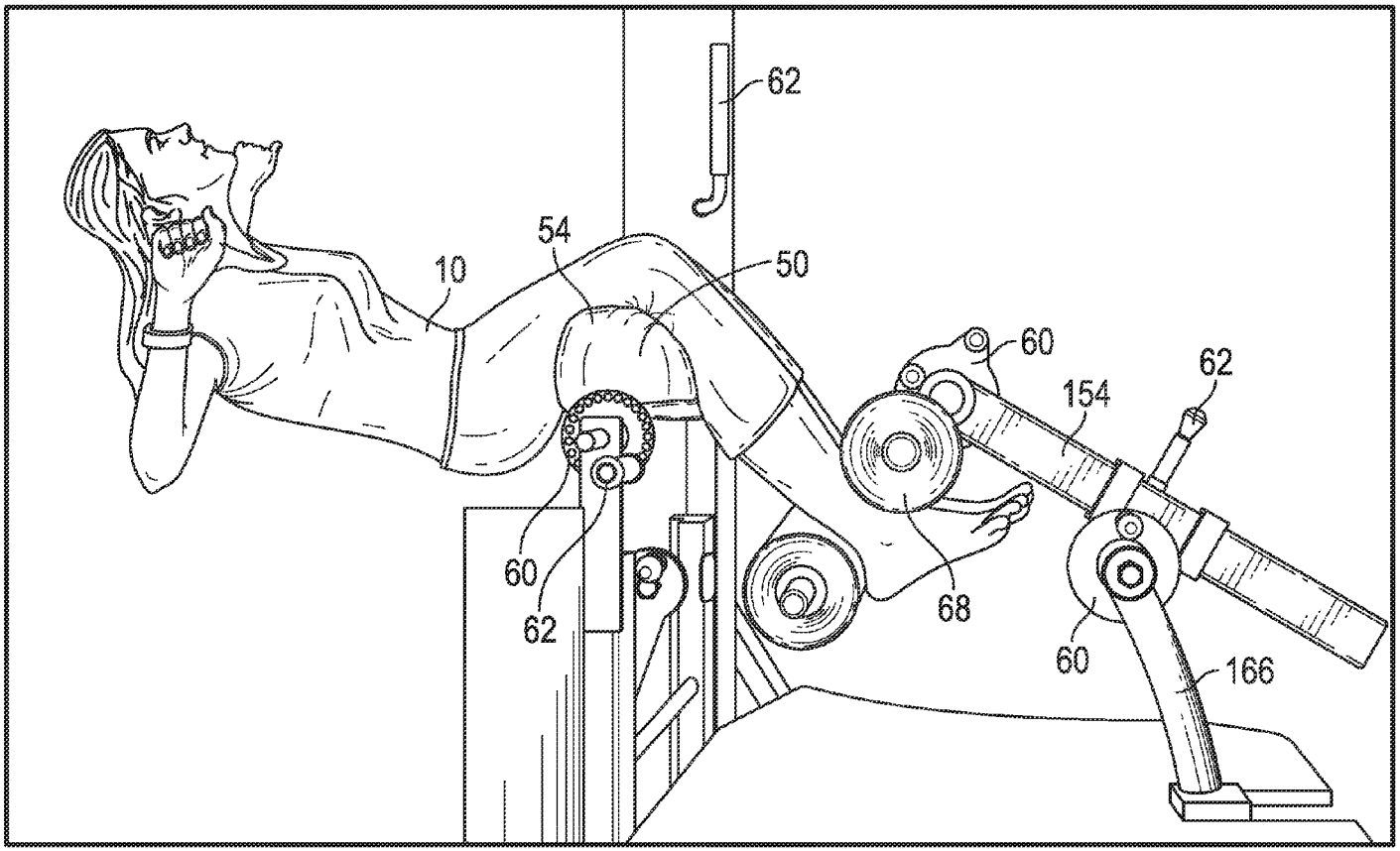

FIG. 3 illustrates a side view of FIG. 2 when fitness device 4 is configured for a user in an unsupported-torso face-up position 10. For a better view, the top part of the housing for the right selectorized weight stack 138 has been removed in this and the subsequent side view (FIGS. 4-11).

Figure 4:
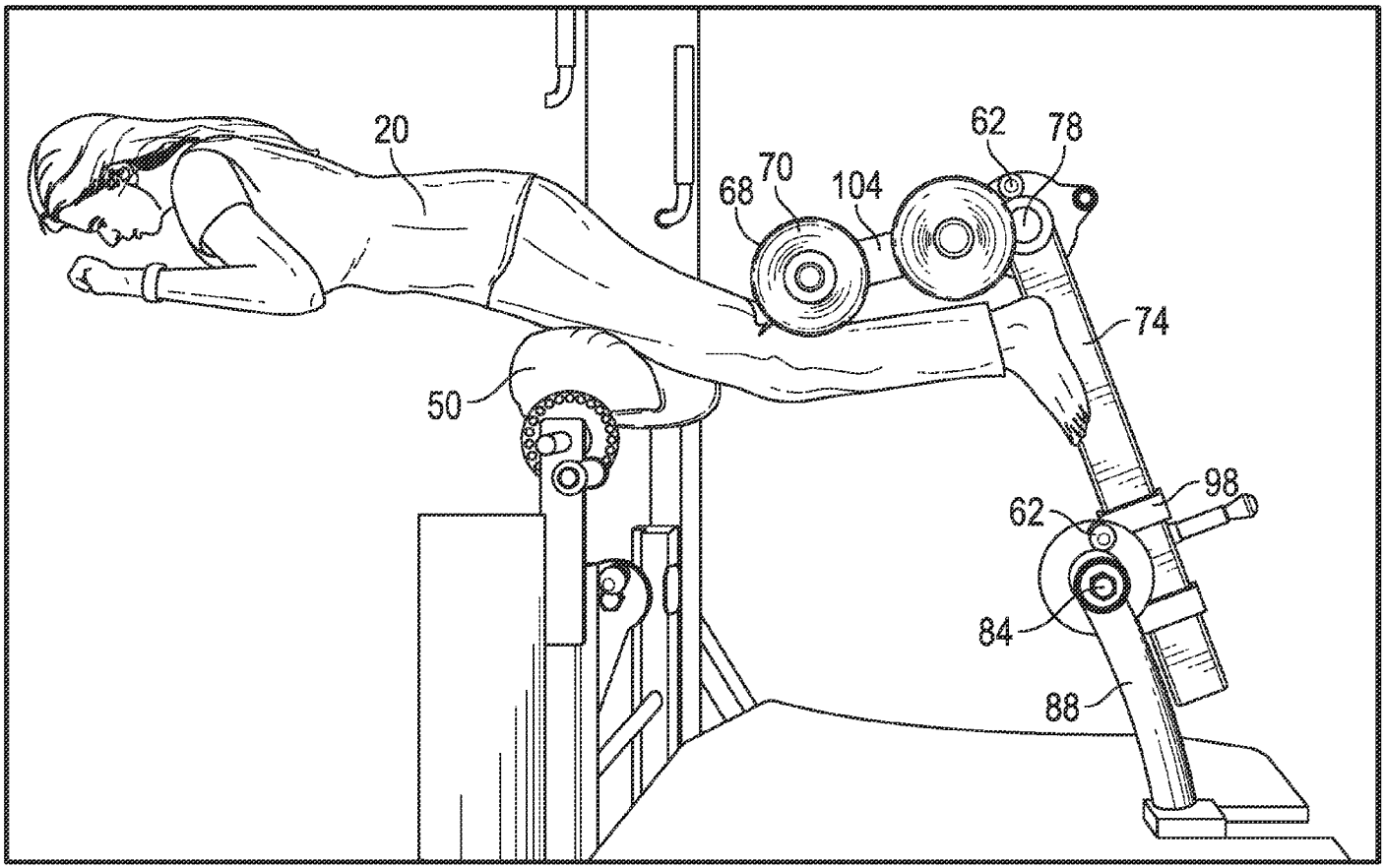

FIG. 4 illustrates a side view of FIG. 2 when fitness device 4 is configured for a user in an unsupported-torso face-down position 20.

Figure 5:
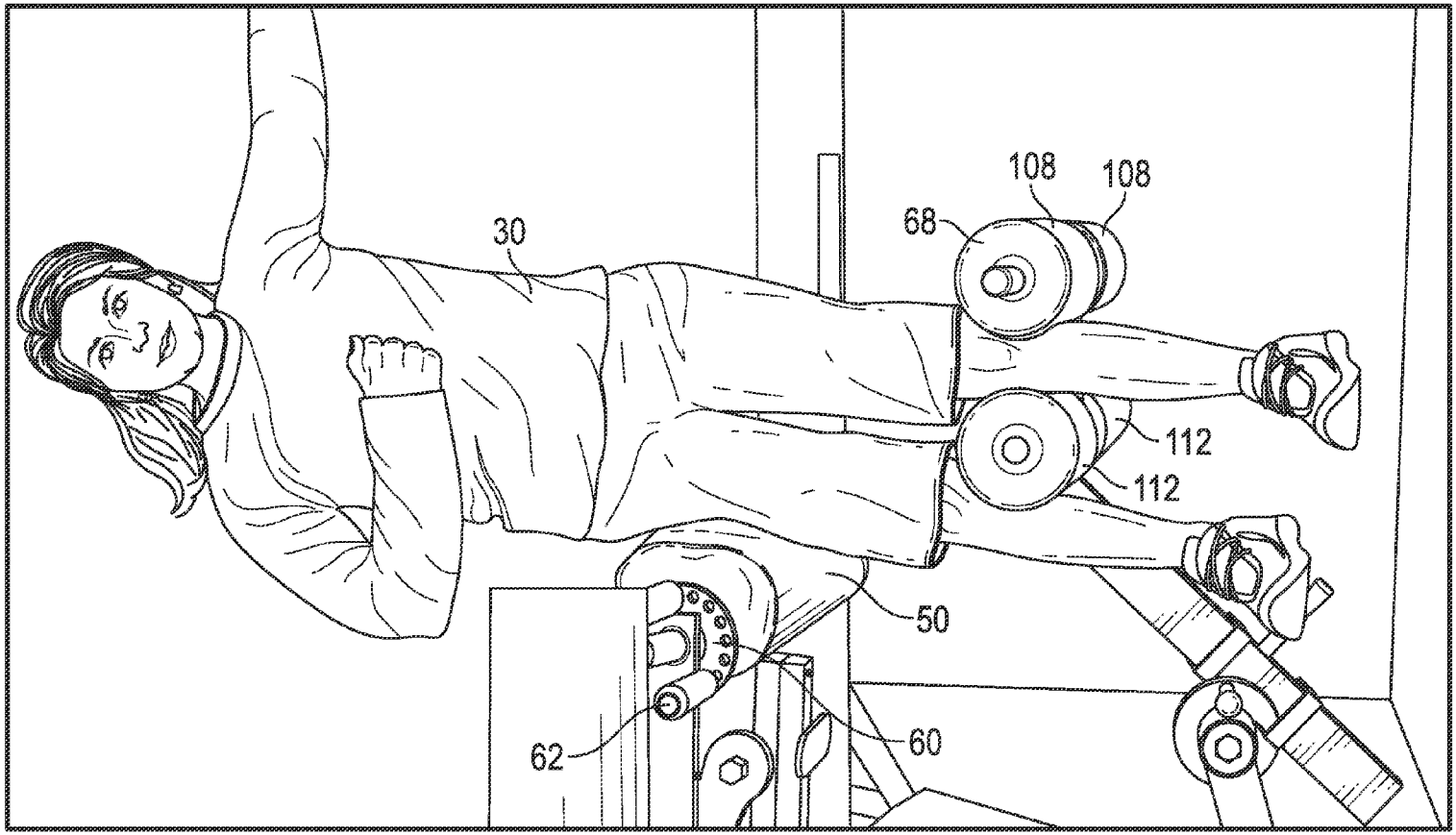

FIG. 5 illustrates a side view of FIG. 2 when the fitness device 4 is configured for a user in an unsupported-torso side-facing position 30.

Figure 6:
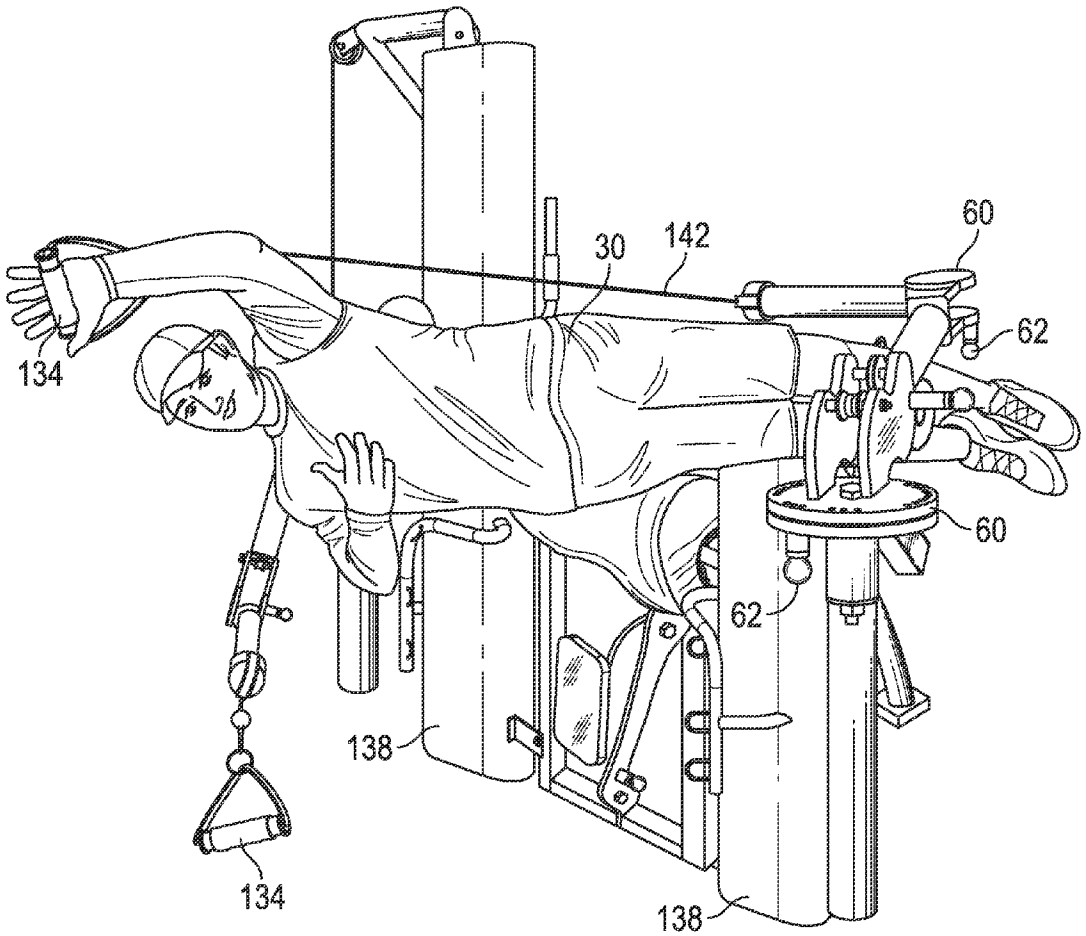

FIG. 6 illustrates a shoulder press exercise in an unsupported-torso side-facing position 30.

Figure 7:
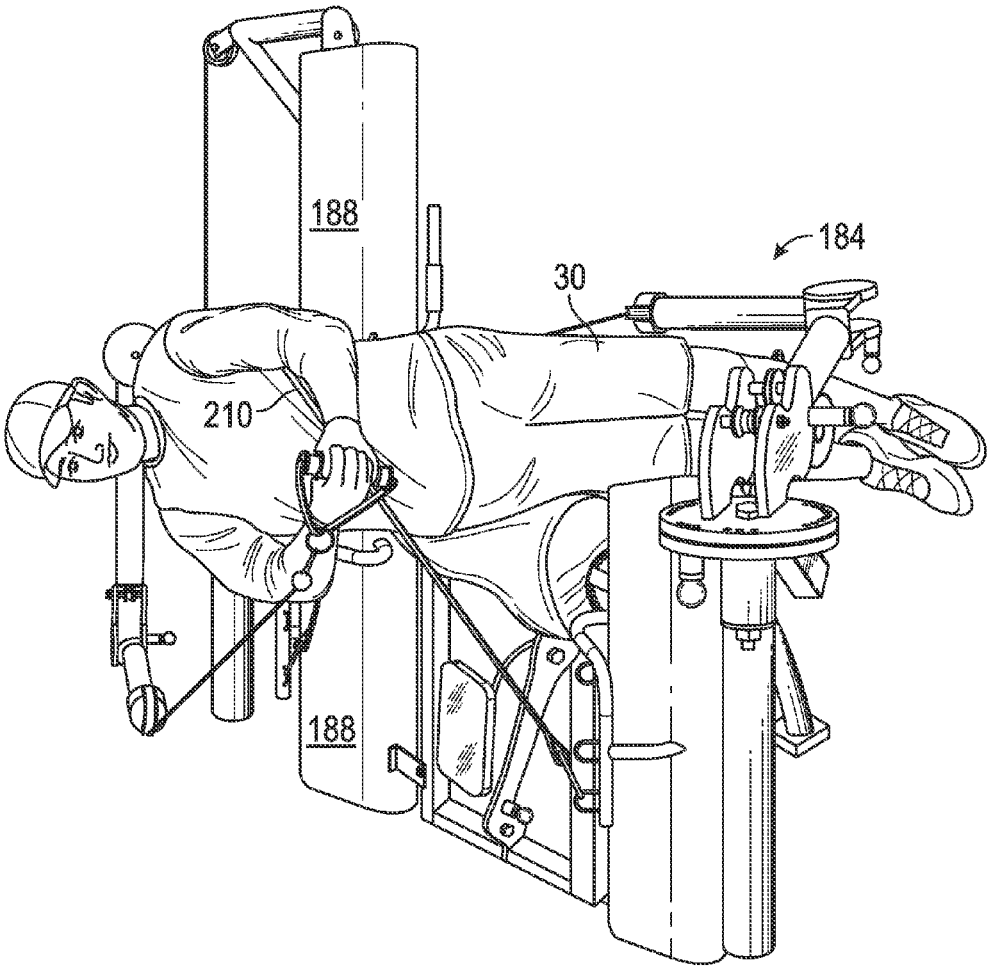

FIG. 7 illustrates a shoulder rotation exercise in an unsupported-torso side-facing position 30.

Figure 8:
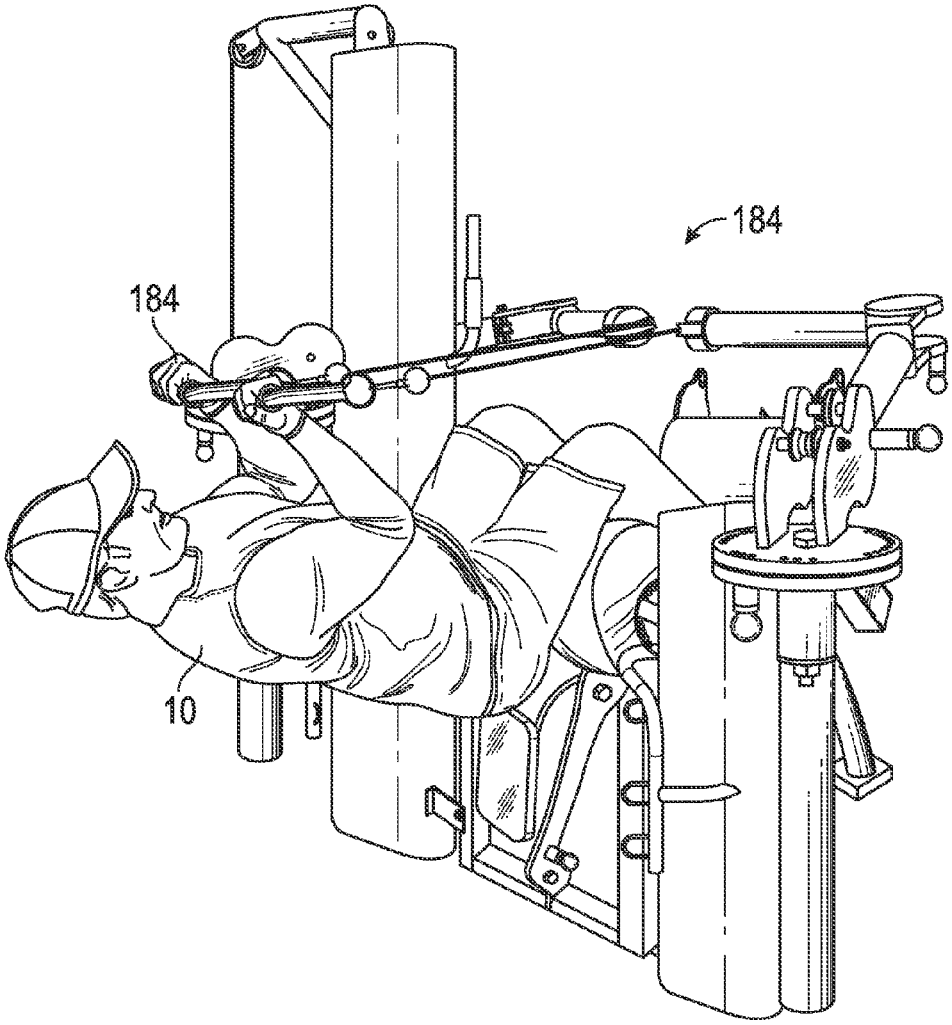

FIG. 8 illustrates a biceps exercise in an unsupported-torso face-up position 10.

Figure 9:
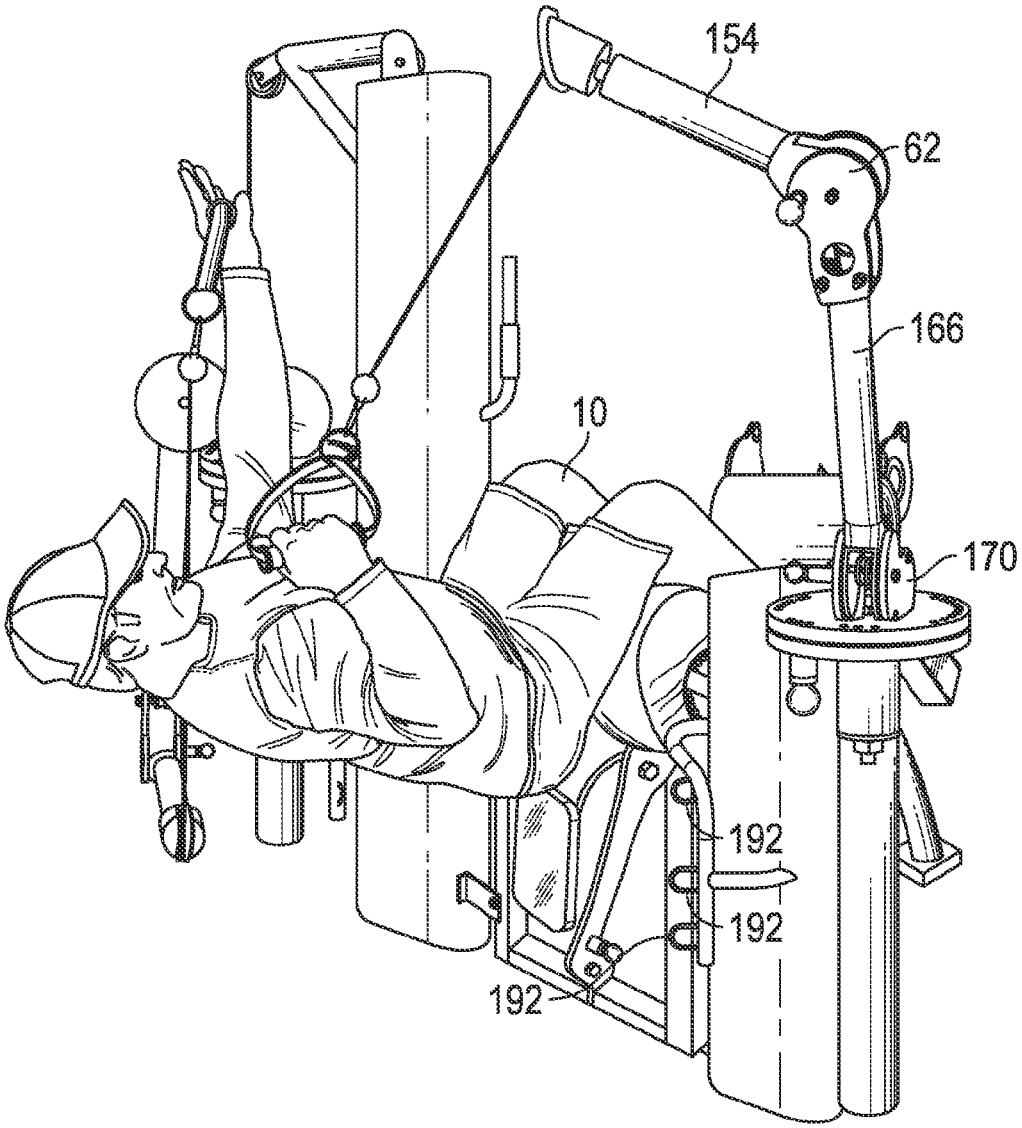

FIG. 9 illustrates a one-arm press and the other-arm pull exercise in an unsupported-torso face-up position 10.

Figure 10:
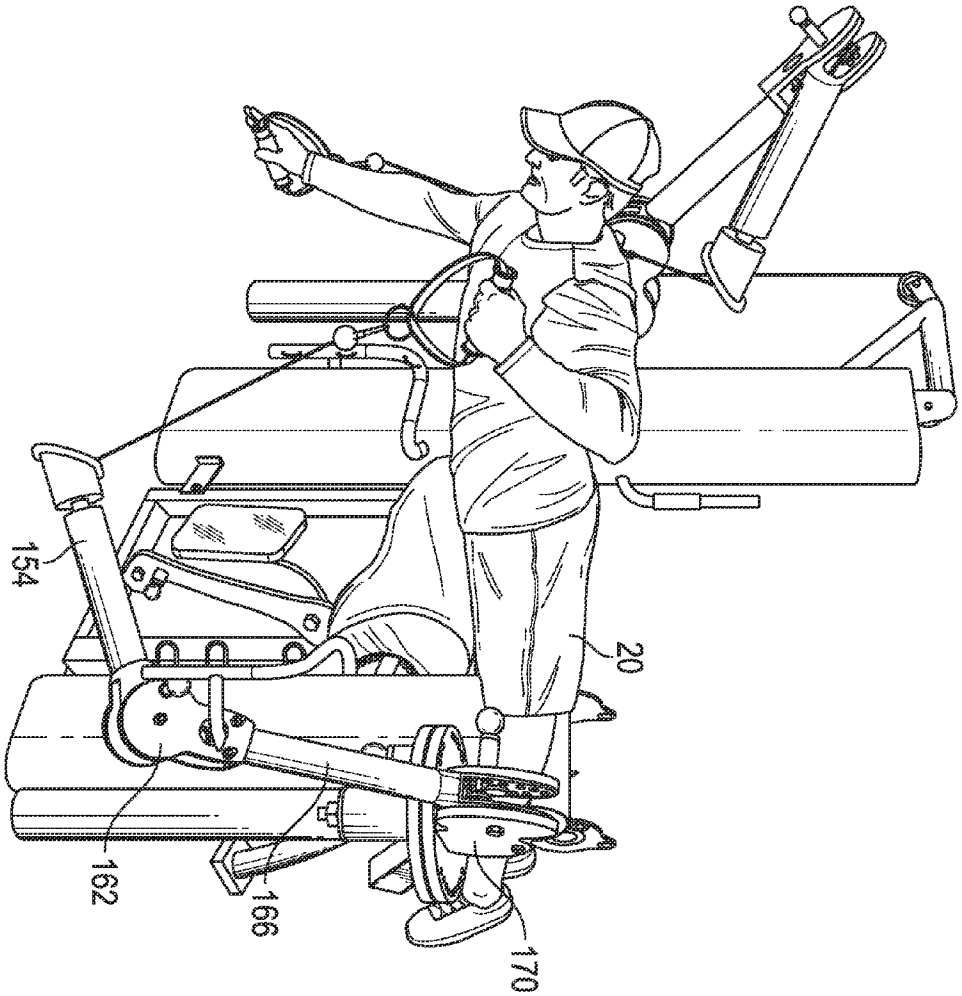

FIG. 10 illustrates a one-arm press and the other-arm pull exercise in an unsupported-torso face-down position 20.

Figure 11:
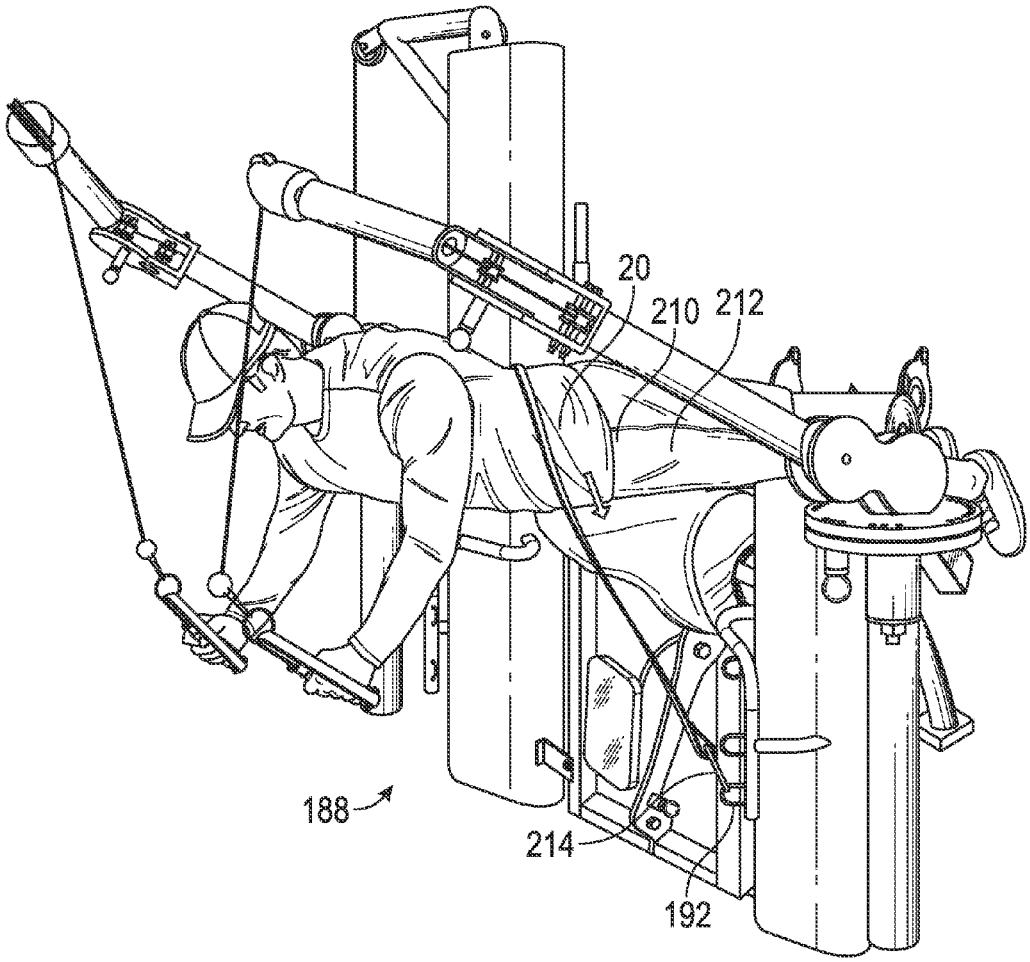

FIG. 11 illustrates a triceps press exercise in an unsupported-torso face-down position 20.

Figure 12:
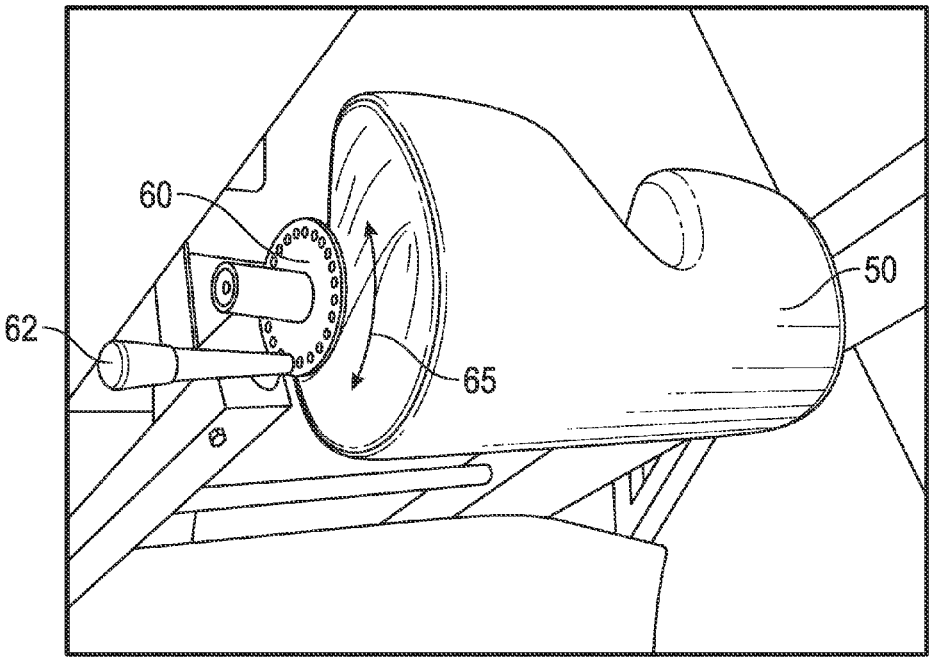

FIG. 12 illustrates the preferred embodiment of a femur pad 50.

Figure 13:
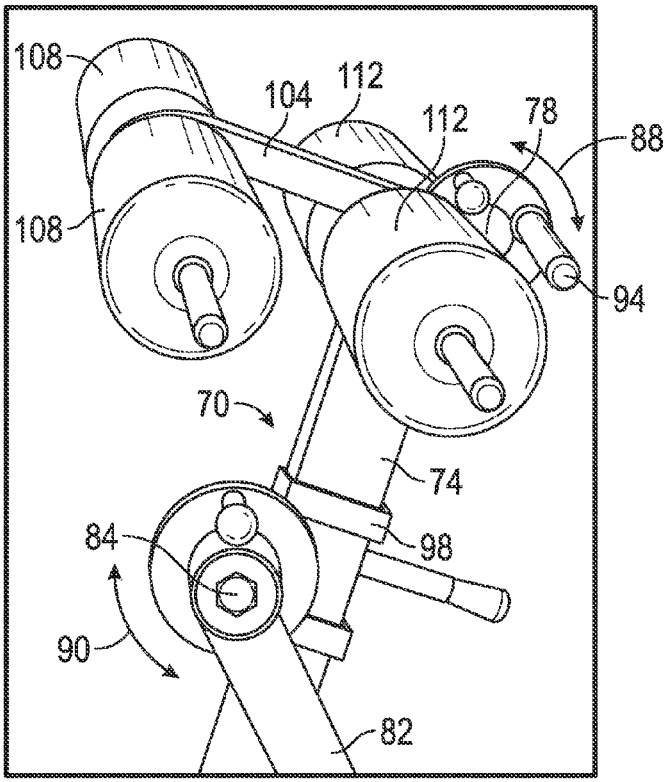

FIG. 13 illustrates the preferred embodiment of a tibia pad 68 and tibia support structure 70.

Figure 14:
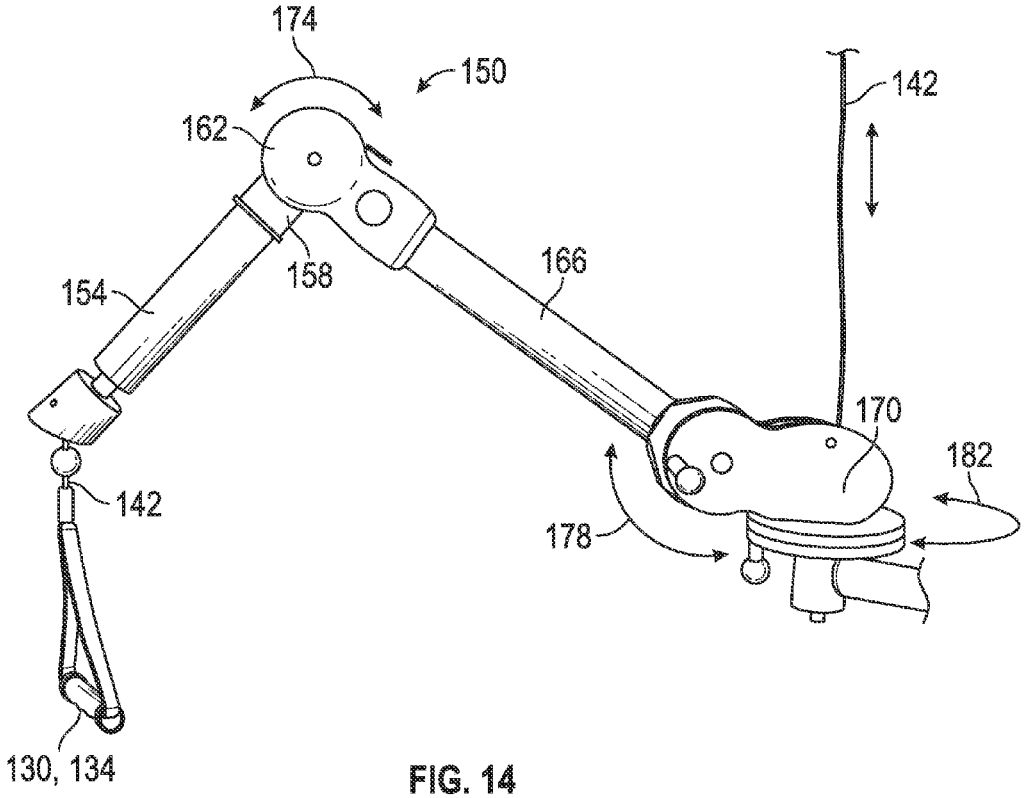

FIG. 14 illustrates the preferred embodiment of a cable support structure 150.

Figure 15:
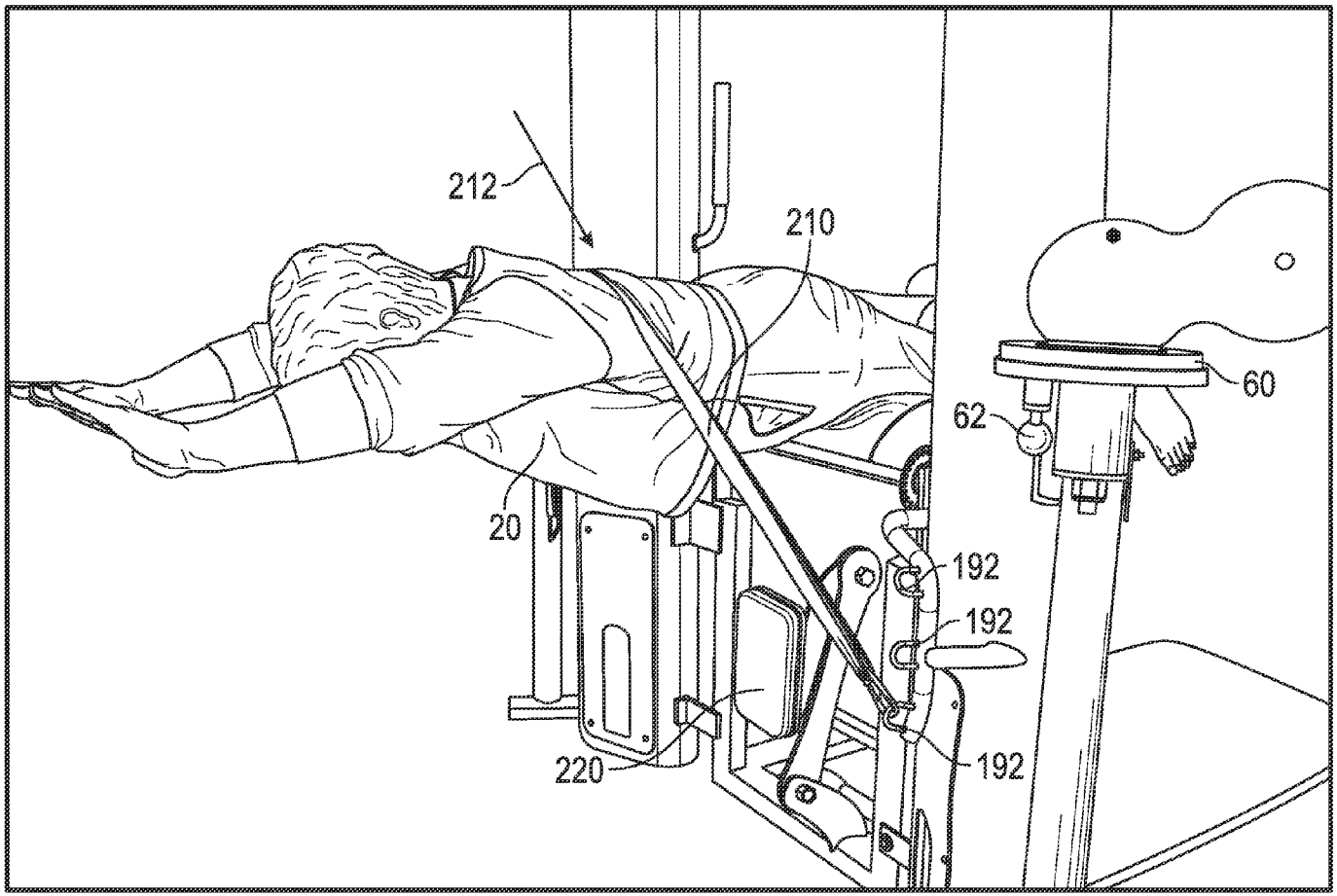

FIG. 15 illustrates a preferred mount 192 and elastic strap 210 configured to create a force vector 212 on a user's torso (obscured by the user's body, the other end of the strap 210 is connected to the opposing mount 192, forming a pair of mounts 194).

Figure 16:
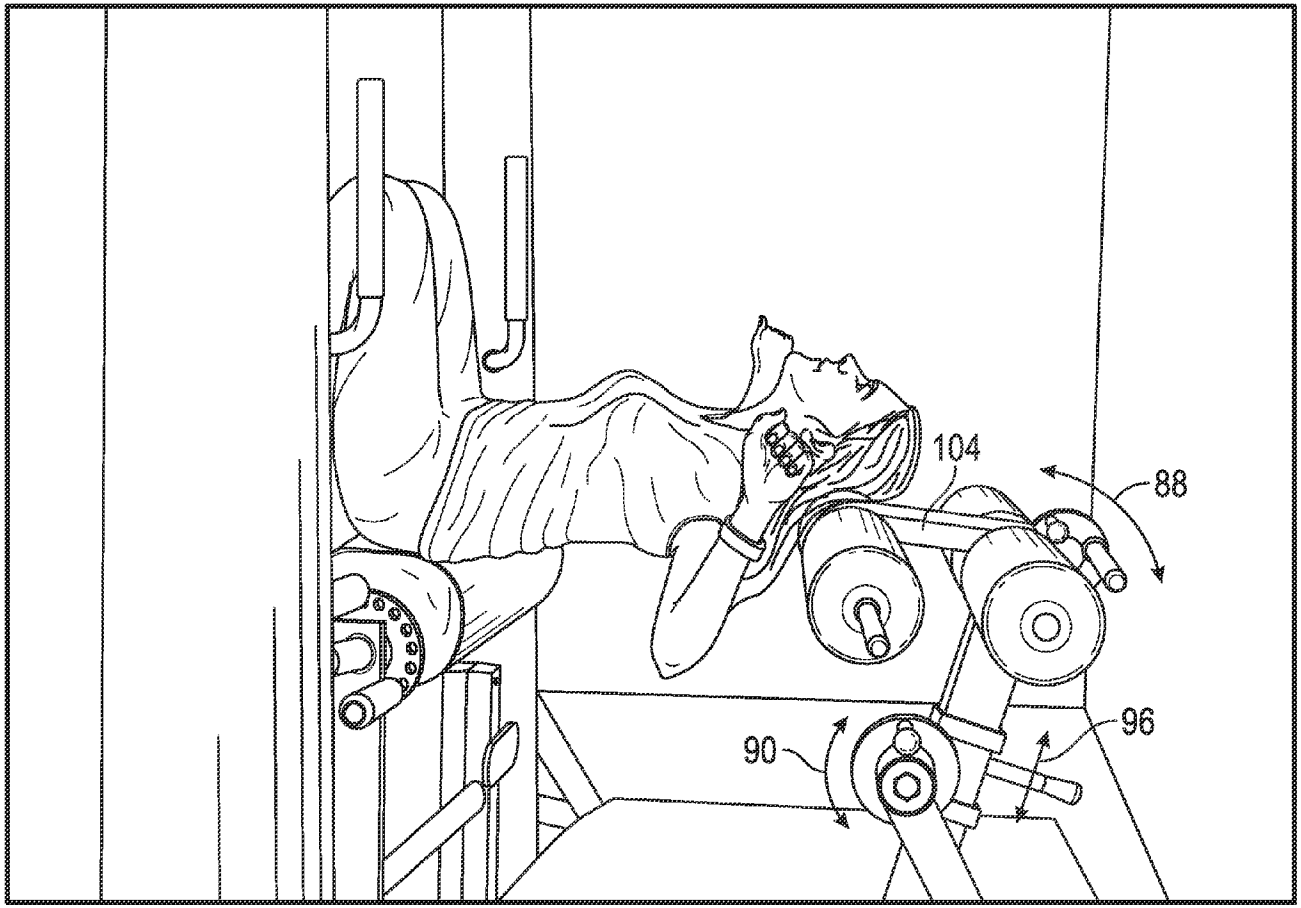

FIG. 16 illustrates a side view of FIG. 2 when the embodiment is configured for a user in a face-up cervical mode.

Figure 17:
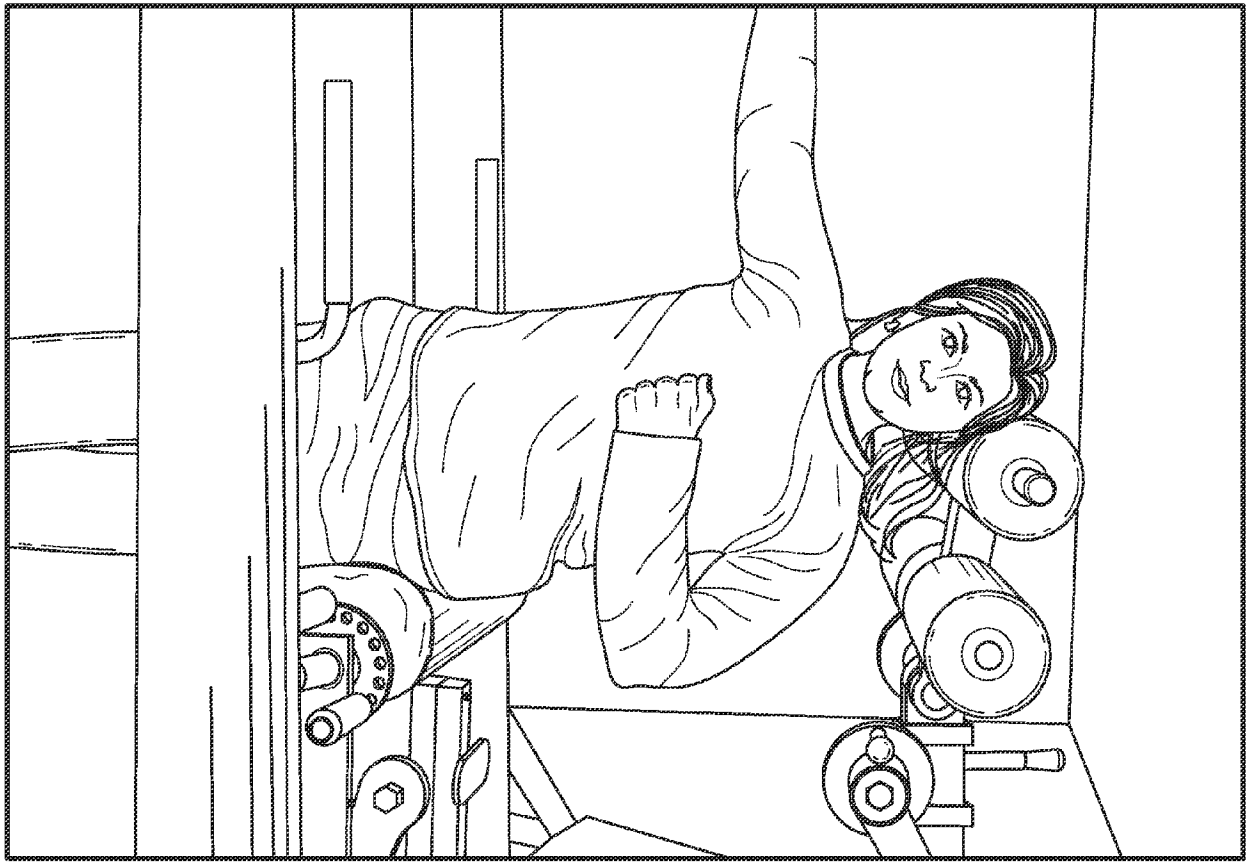

FIG. 17 illustrates a side view of FIG. 2 when the embodiment is configured for a user in a side-facing cervical mode.

DETAILED DESCRIPTION

Today's fitness industry offers a seemingly limitless variety of exercise theories and styles. While some of the available theories and styles are directed to training the "core" in an effort to counteract today's sedentary lifestyle, none of them are configured to only support a user's lower body below the greater trochanter and intentionally not supporting a user body above the greater trochanter while the user engages in various degrees of movement and force production with the upper body in a substantially horizontal position. As demonstrated below, the preferred embodiment of the invention effectively requires a user's upper body act to act as a third class lever when resisting external loading, with the hips as the fulcrum.

Figure 1:
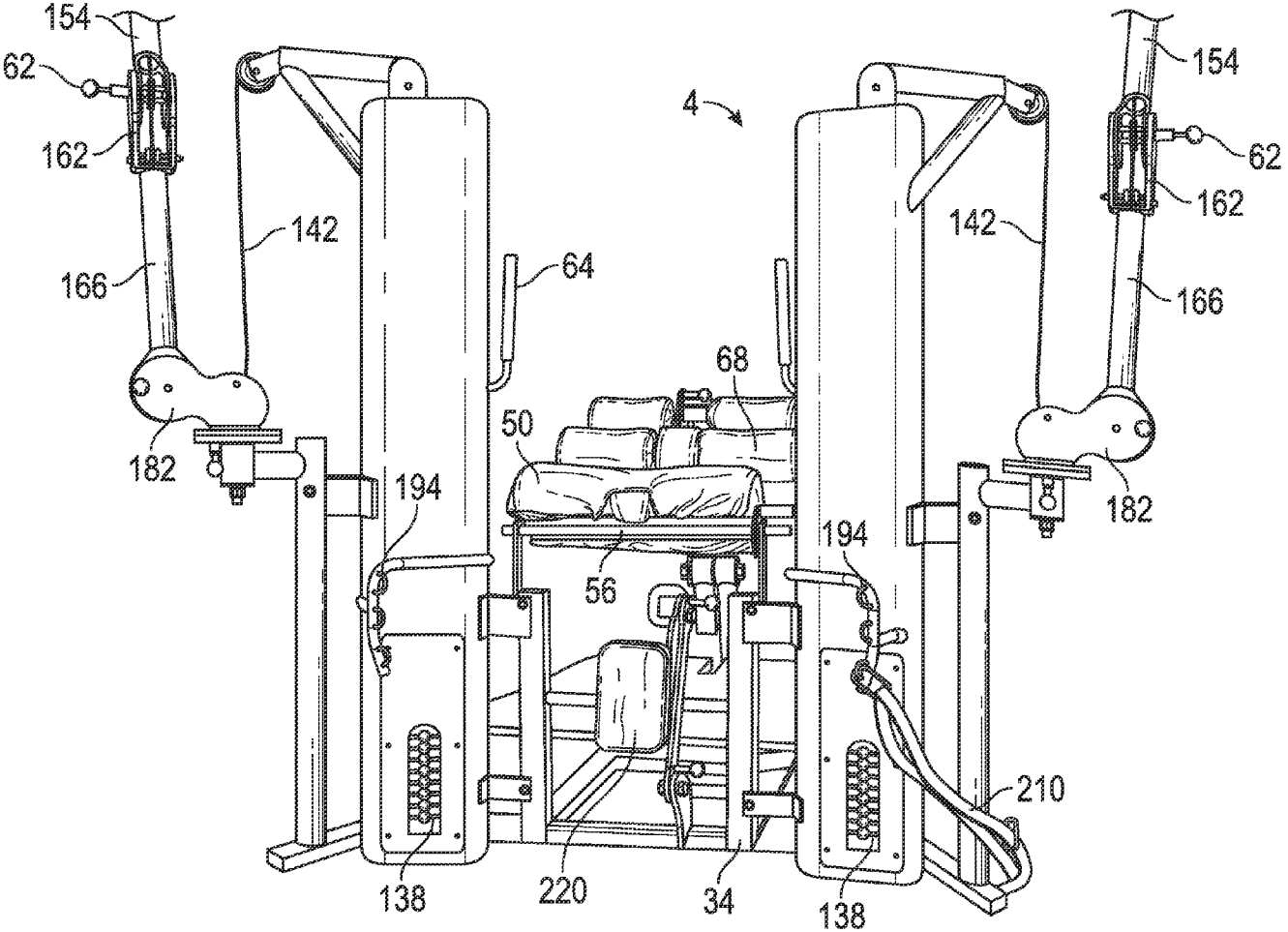
FIG. 1 illustrates a front perspective view of the preferred embodiment of the fitness device.

FIG. 1 depicts a fitness device 4 embodying the principles of the present invention. FIGS. 3-5 depict how fitness device 4 provides an environment that positions its user to optimize the user's biomechanical systems. In combination, femur (or "mid-assembly") pad 50 and tibia pad 68 create an environment that effectively mandates a user's natural biomechanical systems to provide the necessary pre-requisite center body stabilization while the user's upper body produces force. When a user's body is in a horizontally third class biomechanical lever environment as shown in FIGS. 3-5, the fitness device 4 effectively mandates proper co-contraction of the core's inner unit and outer unit to optimize fully integrated biomechanics.

The three positions shown in FIGS. 3-5 (unsupported-torso face-up 10, unsupported-torso face-down 20, and unsupported-torso side-facing 30) can greatly reduce or in some cases, eliminate the compressive spinal loading that typically occurs during use of conventionally designed equipment. As shown in FIGS. 3-5, the fitness device 4 essentially mandates that a user's upper body operate as a third class lever with the user's hips as the fulcrum with or without a user's upper extremities generating various degrees of force production.

FIG. 3 depicts a user in an unsupported-torso face-up position 10. As shown, a femur pad 50 has been configured to support the user between the user's lower femur and upper tibia. As shown, the femur pad 50 does not offer any support underneath the pelvis or the upper femur. The tibia pad 68 has been configured to support a user's lower tibia/ankle.

FIG. 4 depicts a user in an unsupported-torso face-down position 20. As shown, the femur pad 50 had been configured to support the user's upper femur, preferably below the user's greater trochanter. The tibia pad 68 has been configured to support a user's upper tibia. FIG. 4 illustrates the preferred configuration of the tibia pad 68 in the unsupported-torso face-down position 20. But positioning the tibia pad 68 anywhere between a user's lower femur and upper tibia is acceptable.

FIG. 5 depicts a user in an unsupported-torso side-facing position 30. As shown, the femur pad 50 had been configured to support the user's upper femur, preferably below the user's greater trochanter. The tibia pad 68 has been configured to support a user's upper tibia. FIG. 5 illustrates the preferred configuration of the tibia pad 68 in the unsupported-torso side-facing position 20. But positioning the tibia pad 68 anywhere between a user's lower femur and upper tibia is acceptable.

It is important to note that the fitness device 4 offers no external support of the user's torso in FIGS. 3-5.

In operation, a user can begin a training continuum by acquiring the necessary pre-requisite center body and cervical spine stabilization strength. This can be accomplished by statically holding oneself in an unsupported-torso in a face-up, face-down, or side-facing position without any moving or generating any force with the upper extremities. FIGS. 3-5. This initial center body stabilization strategy can be progressed by a user holding a horizontal position for increasing amounts of time.

Once sufficient center body stabilization has been acquired, users can further increase strength by generating various degrees of resisted open kinetic chain upper extremity force production via a plurality of movement patterns. Additionally, once users have realized preferred levels of optimal functional anatomy and biomechanics during force production, they can safely and effectively engage in enhancing power production.

Power training involves producing force by coordinating center body and extremity movement together, coupled with a speed or velocity element. The entire spectrum of resistance training described can be thought of as the progressive exercise continuum.

By way of the examples, as shown in FIG. 3-5, a user can engage in a static center body holding. Alternatively, by way of example, a user can engage in a variety of push/pull movement patterns as shown in FIGS. 9-10, pressing movements (FIG. 6), or bicep/tricep movements (FIGS. 8, 11), rotational movements (FIG. 7). For these exemplary movements, the user is attempting to keep the torso as horizontal as possible during exercise. The movement is predominantly performed by the arms (i.e., the upper extremities).

The additional combinations and permutations available to a user of fitness device 4 are both wide and deep. For example, although not shown, one could generate power by the throwing of a lightly weighted ball from one hand to the other in the face-up position 10. One could utilize two handed movements, such as shown in FIG. 7. One could execute a rowing movement with one or two hands in the face-down position. Another alternative is to put only one leg on the tibia pad, letting the other leg be free to move, and then engaging in any of these exercises. This would change the dynamic forces on the body but retain the ethos of the fitness device 4.

The various embodiments of the invention provide both an exercise methodology and facilitative apparatus. By exploiting a mechanical disadvantage of putting a user's upper body into a third class lever environment, the fitness device 4 provides heightened return of muscle strength to support anatomically correct leg/hip/spine movement—which translates directly into supporting correct anatomical movement in all aspects of real life human function.

In part, the mechanical disadvantage a user faces when exercising in the unsupported torso positions is believed to create an inverse functional anatomical advantage as a result of the resulting muscle growth. Namely, that it more effectively mandates optimal center body activation during hips fulcrum third class levered horizontal loading, wherein the upper extremities generate force in an open kinetic chain environment.

Preferred Re-Configurable Lower Body Support

As shown in FIGS. 1 and 2, the preferred fitness device 4 rests on a base frame 34. A base platform 38 sits on top of the base frame 34. A conventional selectorized weight stack 138 is connected to a left side 42 and a right side 46 of a front end 48 of the base frame 34. A femur pad 50, which preferably has a rounded exterior surface 54, is connected between the left 42 and right 46 weight stacks 138 by a center bar 56. The fitness device 4 is preferably constructed from metal, like steel, with comfort padding and rubber grips added as is conventionally known in the art.

Although a fixed femur pad 50 is suitable, it is preferred that the femur pad 50 be configured to rotate about the center bar 56. Such rotatability can be accomplished in many ways. It is preferred to achieve at least 90 degrees of selectorized rotation 65 by employing a pair of perforated plates 60 and a pop pin 62. See, FIG. 12. With the pop pin 62 out, a user can rotate the femur pad 50 to the desired position and then fix the femur pad 50 by inserting the pop pin 62 through aligned holes in the pair of perforated plates 60.

While there are a variety of ways the tibia pad 68 can be made selectively re-configurable to the face-up 10, face-down 20 and side-facing 30 positions described above, it is preferred to achieve such configurability with the tibia pad support structure (or "rear assembly") shown in the figures. See, e.g., FIG. 13. As shown, the preferred tibia pad support structure 70 comprises a first member 74 configured to transmit force between the tibia pad 68 and a first joint 78, a second member 82 configured to transmit force between the first joint 78 and a second joint 84, the first joint 78 configured to permit rotation in at least one plane 88, the second joint 84 configured to permit rotation in at least one plane 90, and the tibia support structure 70 configured to permit adjustability of the distance between the first and second joints (78, 84). The second member 82 would preferably be connected to the base frame 34.

The preferred tibia pad 68 is a set of four pads (122-125) connected by a rigid center member 104. See, FIG. 2. A first pair of pads 108 can be connected to the center member 104 so that the pads of the pair are concentrically aligned. See, FIGS. 5, 13. Likewise, a second pair of pads 112 can be connected to the center member 104 so that the second pair of pads 112 is also concentrically aligned. The two pairs of pads can then be separated from each other by the center member 104 to allow for a user's legs to fit between the two pairs as shown in FIGS. 3-5.

While there are a variety of ways to configure the tibia support structure 70 to achieve rotation in at least one plane at the first joint 78 and the second joint 84, it is preferred to achieve such rotation by employing a pair of perforated plates 60 and a pop pins 62 in much the same fashion as previously described for the rotating femur pad 50. Similarly, it is preferred to permit adjustability of the distance between the first joint 78 and the second joint 84 by again employing pop pins 62, this time via a telescoping female connection 98 that allows the first member 82 to slide through the telescoping female connection 98. Perforations in the first member 82 receive pop pin 60 to lock the first member 82 relative to connection 98.

Together, the preferred tibia pad support structure 70 creates bi-rotational and translational capacity 96 of the tibia pad 68. The combined rotational capacity of the first and second joints (78, 84) and the telescoping ability of the first member 78, permit selective adjustability of the angular relationships relative to the rotational femur pad 50 and the user's desired degree of knee flexion in the center body face-up or face-down positions, lower extremity positioning for the center body side position, as well as the degree of difficulty in the up and side cervical positions.

Adjustment of the different combinations of rotation and translation can be made easier by the additions of handgrips 94 to a distal end of the first member 78. Handgrips 94 can assist sliding the first member 78 in relation to the telescoping female connection 98. Among other things, the gliding telescoping aspect of the first member 78 provide the user with the ability to appropriately adjust the tibia pad 68 to accommodate individually differing tibia lengths in the center body positions, and to respective torso lengths in the cervical positions.

Upper Body Resistance Options

The variety of upper body resistance options are, as a practical matter, limited only by the imagination. At a minimum, a user can begin by merely attempting to hold the upper body in an unsupported-torso horizontal position for a length of time, preferably an ever-increasing length of time, in either of the three base positions: face-up, face-down, and side-facing. Gravity alone provides a force that mandates contraction of the deeper spinal stabilizers (the "inner unit") as well as an ideal ratio of co-contraction between deeper stabilizers (the "inner unit") and more superficial prime movers (the "outer unit"), which together comprise the body's "core."

Adding external loading to the upper body increases the effect. External loading can take the form of traditional resistance devices. For purposes of this specification, the term "resistance device" should be broadly understood to include devices known in the art to provide resistance (e.g., dumbbells, kettle bells, magnetic resistance, pneumatic resistance, compressed air, spring, rotational inertial resistance, etc.). Of course, resistance devices like traditional cable/pulley/selectorized weight stack mechanisms will work and, as discussed below, are presently preferred.

Triple Articulating Arm

The preferred resistance device 130 starts with a traditional handle 134 connected to a selectorized weight stack 138 by a cable 142, all of which are well-known in the art. But to enable the handle 134 to be selectively located in a space above a user's lower body 184 (see FIGS. 6, 8) or in a space around a user's torso 188 (see FIGS. 7, 9, 10, 11) when the user exercises on the fitness device in the unsupported-torso face-up position 10, the unsupported-torso face-down position 20, or the unsupported-torso side-facing position 30, a cable support structure 150 as shown in FIG. 14 is preferred.

Turning to FIG. 14, the preferred cable support structure 150 has a first arm 154 configured to transmit force between an end 158 of the first arm 154 and an elbow joint 162. A second arm 166 is configured to transmit force between the elbow joint 162 and a shoulder joint 170. (The terms "elbow joint" and "shoulder joint" are used for reference identification purposes and are not meant as structural limitations.) The elbow joint 162 is configured to permit rotation in at least one plane 174. The shoulder joint 170 is configured to permit rotation in at least one plane 178. In addition, shoulder joint 170 is also preferably configured to permit rotation in a second plane 182. The shoulder joint 170 would preferably be connected to the base frame 34.

While there are a variety of ways to configure the cable support structure to achieve rotation in at least one plane 174 at the elbow joint 162 and preferably at least two planes 178, 182 in the shoulder joint 170, it is preferred to achieve such rotation by employing a pair of perforated plates 60 and a pop pins 62 in much the same fashion as previously described for the rotating femur pad 50 and the tibia pad support structure 70.

As shown in most of the figures, and particularly FIG. 14, a combination of perforated plate pairs 60 and pop pins 62 can provide rotation at the elbow joint 162 and vertical and horizontal rotation at the shoulder joint 170. When configured in this way, a handle 134 connected to the weight stack 138 by a cable 142 (the cable being guided between the handle 134 and the weight stack 138 by pulleys inside the cable support structure in the conventionally known ways) can be strategically placed at almost any position and angle around a user as shown in FIGS. 6-11. As exemplified by this embodiment, a cable support structure 150 configured in this way can provide users with the maximum number of handle 134 positioning possibilities and a plurality of resistive force vectors, when the user is holding the body as much as possible in a static horizontal position by the lower extremity holding mechanism (femur 50 and tibia pads 68).

Other Optional Embodiments

Elastic Strap

For use with or without the resistance devices 130 described above, it is also preferred to have the option of one or more elastic straps (bands) 210 removably connected to a plurality of mounts 192. The mounts are preferably secured to the fitness device 4 in pairs, in a horizontal plane below a top of the femur pad 50, with the mounts 192 straddling a centerline 52 of the femur pad 50 in a vertical plane. See, e.g., FIG. 2.

In operation, a user of fitness device 4 connects the elastic strap 210 to the pair of mounts to create a force vector 212 on the user's torso when the user is exercising. See, e.g., FIGS. 7, 11, and 15. Those in the art will recognize a variety of ways to secure mounts 192 and removably connect an elastic strap 210 to the mounts. The preferred way secure the mounts 192 is to weld a metal u-shaped mount 192 to a structural element near the weight stack 138 as shown in FIGS. 9, 15. The preferred way to removably connect the elastic strap 210 is to use an elastic band for the strap 210 and to use a conventional carabiner 214 to connect the band to the mount 192.

Cervical

A user can strengthen the muscles supporting the cervical spine by adopting the positions shown in FIGS. 16, 17 (face-up and side facing). In addition, although not shown in the figures, a user can adopt a corresponding face-down position, too. It is preferred to add a head pad 128 between at least one of the pairs of pads 108, 112.

The training continuum for the cervical spine is the same as previously discussed: a user begins with a static hold for increasing lengths of time and then adds external loading as a user's strength permits. For example, once a user can maintain a static hold, the user can progress to holding dumbbells by hand in any of the positions to increase the cervical spine strength needed to resist the load.

Hyperextension Pad

In the early stages of strength development, some users will benefit from external torso support in the face-up position 10. In such case, a hyperextension pad 220 to support the user's torso can be useful. The hyperextension pad 220 can be rotationally connected to the base frame 34 so that it can be stored upright and out of the way most of the time. When needed, the hyperextension pad 220 can be rotated down and selectively adjusted to the desired height and angle using perforated plates 60 and pop pins 59 as previously described. In this way, a user can use the pad 220 as needed for support while gaining the core strength to achieve the unsupported torso positions 10, 20, and 30.

Upright Handles

To assist a user enter and exit the device 4, access handles 64 can be added. It is preferred to add access handles 64 in the locations shown in FIG. 1.

Stand Alone Machines

While the fitness device 4 shown in FIGS. 1-17 exemplifies the presently preferred embodiments of the invention, stand-alone versions of the unsupported-torso face-up position 10 by itself, the unsupported-torso face-down position 20 by itself, or unsupported-torso side-facing position 30 by itself can be made and used to engage a subset of movements previously described and shown in FIGS. 1-17. For "stand-alone" embodiments, it is preferred simplify the tibia pad support structure 70 by eliminating the adjustable rotation configurability of the first joint 78 and leaving a rigid connection in its place to support either the face up 10, the face-down 20, or the side-facing 30 positions.

Likewise if desired, movement-specific, stand-alone devices can also be made and used, too. For the purposes of this specification, a "movement-specific, stand-alone" device refers to a device devoted to one movement (e.g. shoulder press) in one position (e.g., side-facing). Movement-specific stand-alone devices are advantageous for creating a training circuit as is well-known in the art.

In addition to the above simplification of the tibia pad support structure, the cable support structure 150 can be simplified to support only a subset of exercise movements. For example, a standalone device can be made and used to support a stand-alone side facing shoulder press (see, FIG. 6), a stand-alone side-facing shoulder rotation (see, FIG. 7), a stand-alone face up bicep curl (see, FIG. 8), and so on.

While the invention has been described by means of specific embodiments, modifications and variations could be made thereto by those ordinarily skilled in the art without departing from the scope and spirit of the invention set forth in the claims. Likewise, the invention is not limited in its operational application to the above details of mechanical angular and special relationships, users biomechanical positioning, various extremity force producing embodiments and of being practiced or of being potentially operationally carried out in various other ways. The phraseology and terminology used herein is for the purpose of description and should not be regarded as limiting. Unless specified or limited otherwise, the terms "supported," and "coupled" and variations thereof are used broadly and encompass both direct and indirect operational possibilities.

What is claimed is:

1. A fitness device for exercising the human body, the fitness device comprising in combination, a base frame supporting a mid-assembly and a rearward assembly, the mid-assembly rigidly supporting a mid-assembly pad, the mid-assembly connected to the base frame, the mid-assembly pad adjustably connected to the mid assembly to permit rotation around an axis transverse to the mid-assembly pad, the rearward assembly connected to the base frame at a horizontal distance away from the mid-assembly pad, the rearward assembly comprising a first member, the first member having a first end, the first end connected to a first joint, the first member rotatable about the first joint, a second member connected to the first joint, the second member rotatable about a second joint, an adjustable connection to permit lengthening or shortening of the distance between the first and second joints, a third member connected to the second joint and the base frame, a first pair of pads connected on opposite sides of the first member, and a second pair of pads connected to opposite sides of the first member.

2. The fitness device of claim 1 further comprising a resistance device connected directly or indirectly to the base frame.

3. The fitness device of claim 2, the resistance device comprising a handle connected to a selectorized weight stack by a cable.

4. The fitness device of claim 3, further comprising a cable support structure configured to support the cable, the cable support structure comprising, a first arm configured to transmit force between an end of the first arm and an elbow joint, a second arm configured to transmit force between the elbow joint and a shoulder joint, the elbow joint configured to permit rotation in at least one plane, and the shoulder joint configured to permit rotation in at least one plane.

5. The fitness device of claim 4, the shoulder joint further configured to permit rotation in a second plane.

6. The fitness device of claim 5, the cable support structure reconfigurable to permit the handle to be selectively located.

7. The fitness device of claim 1 further comprising a pair of mounts for receiving an elastic strap, the mounts located in a horizontal plane below a top of the mid-assembly pad and the mounts straddling a centerline of the mid-assembly pad.

8. The fitness device of claim 7 further comprising an elastic strap removably connected between the pair of mounts.

9. A fitness device for exercising the human body, the fitness device comprising, a base frame, the base frame comprising a front area and a back area, a mid-assembly, the mid-assembly connected to the base frame, the mid-assembly comprising a mid-assembly pad, a rearward assembly, the rearward assembly connected to the base frame closer to the back area of the base frame than where the mid-assembly is connected to the base frame, the rearward assembly comprising a rearward pad, an arm assembly, the arm assembly connected to the base frame, the arm assembly comprising, a first arm assembly joint rotatable about a first axis, a second arm assembly joint rotatable about a second axis, a third arm assembly joint rotatable about a third axis, a first arm connected between the first arm assembly joint and the second arm assembly joint, a second arm connected between the second arm assembly joint and the third arm assembly joint, and a third arm, the third arm comprising a first end and a free end, the first end connected to the third arm assembly joint, the free end extending outward from the first end in a direction perpendicular to the third axis.

10. The fitness device of claim 9 further comprising a resistance device supported by the free end.

11. The fitness device of claim 10, wherein the resistance device comprises a selectorized weight stack connected to a handle by a cable.

12. The fitness device of claim 9, wherein the arm assembly is adjustable to permit spatial relocation of the free end.

13. The fitness device of claim 9, further comprising a pair of mounts for receiving an elastic strap, the mounts located in a horizontal plane below a top of the mid-assembly pad and the mounts straddling a centerline of the mid-assembly pad.

14. The fitness device of claim 13 further comprising an elastic strap removably connected between the pair of mounts.

15. A fitness device for exercising the human body, the fitness device comprising, a base frame, the base frame comprising a front area and a back area, a mid-assembly, the mid-assembly connected to the base frame, the mid-assembly comprising a mid-assembly pad, a rear assembly, the rear assembly connected to the base frame closer to the back area of the base frame than where the mid-assembly is connected to the base frame, the rear assembly comprising a rear pad, an arm assembly, the arm assembly connected to the base frame, the arm assembly comprising, a first joint rotatable about a first axis, a second joint rotatable about a second axis, a third joint rotatable about a third axis, a fourth joint rotatable about a fourth axis, a first arm connected between the first joint and the second joint, a second arm connected between the second joint and the third joint, a third arm connected between the third joint and the fourth joint, and a fourth arm comprising a first end and a free end, the first end connected to the fourth joint.

16. The fitness device of claim 15 further comprising a resistance device supported by the arm assembly.

17. The fitness device of claim 16, wherein the resistance device comprises a selectorized weight stack connected to a handle by a cable.

18. The fitness device of claim 15, wherein the arms of the arm assembly are adjustably connected to each other to permit spatial relocation of a handle.

19. The fitness device of claim 15, further comprising a pair of mounts for receiving an elastic strap, the mounts located in a horizontal plane below a top of the mid-assembly pad and the mounts straddling a centerline of the mid-assembly pad.

20. The fitness device of claim 19 further comprising an elastic strap removably connected between the pair of mounts.

* * * * *